United States Patent [19]

Kanzaka

[11] 4,325,185

[45] Apr. 20, 1982

[54] APPARATUS FOR GAPPING A CONTINUOUS SLIDE FASTENER STRINGER

[75] Inventor: Yoshihiro Kanzaka, Nyuzen, Japan

[73] Assignee: Yoshida Kogyo K.K., Tokyo, Japan

[21] Appl. No.: 107,827

[22] Filed: Dec. 28, 1979

[30] Foreign Application Priority Data

Dec. 28, 1978 [JP] Japan ..... 53-164829

[51] Int. Cl.[3] ..... B23P 21/00

[52] U.S. Cl. ..... 29/770; 29/408

[58] Field of Search ..... 29/770, 408, 410, 332, 29/426, 427

[56] References Cited

U.S. PATENT DOCUMENTS 4,019,240 4/1977 MacFee ..... 29/770
4,062,100 12/1977 Heimberger ..... 29/770
4,236,293 12/1980 Morita ..... 29/770

FOREIGN PATENT DOCUMENTS 48-32222 10/1973 Japan .

*Primary Examiner*—Harold D. Whitehead
*Attorney, Agent, or Firm*—Hill, Van Santen, Steadman, Chiara & Simpson

[57] ABSTRACT

An apparatus for gapping a continuous slide fastener stringer comprises: a presser unit having a punch and a coacting die for pressing a group of fastener elements, in a selected portion of the stringer placed therebetween, to reduce the thickness of their leg portions, and for holding the pressed fastener elements; and a gripper unit having a pair of relatively pivotable grip members for gripping a stringer tape on the opposite sides of the stringer, the gripper unit being disposed alongside of the presser unit to grip the tape from the fastener-element side of the stringer and being movable between its normal position and its advanced position along an arcuate path for moving the gripped tape to remove the pressed and held fastener elements therefrom seriatim.

5 Claims, 11 Drawing Figures

APPARATUS FOR GAPPING A CONTINUOUS SLIDE FASTENER STRINGER

BACKGROUND OF THE INVENTION

1. Field of the Invention

The present invention relates to an apparatus for gapping a slide fastener stringer having a continuous row of fastener elements secured to a stringer tape along a longitudinal edge thereof.

2. Prior Art

Japanese Patent Publication No. 48-32222, issued Oct. 4, 1973 for a method of gapping a continuous slide fastener stringer, discloses the concept of moving a stringer tape away from a group of fastener elements to be removed therefrom and vice versa after those fastener elements are pressed at their leg portions. Although there is no concrete description for structural features, various figures of the Japanese Publication No. 48-32222 indicate that a pair of grippers is disposed at the tape side of a stringer to grip a stringer tape from that side. With such arrangement, correct and easy positioning of the slide fastener stringer is difficult to achieve in apparatus of the type in which the stringer is to be placed by hand.

SUMMARY OF THE INVENTION

According to the present invention, a gripper unit is disposed alongside of a presser unit to grip a tape of a slide fastener stringer from the fastener-element side of the stringer. Therefore, the stringer to be gapped can be placed between a punch and a die of the presser unit and between a pair of upper and lower grip portions of the gripper unit with maximum ease, at which time a group of the fastener elements to be pressed can be positioned between the punch and the die correctly.

Further, the gripper unit follows an arcuate path as it is moved from its normal position to its advanced position. With this arrangement, the fastener elements in a first portion of the stringer to be gapped can be removed seriatim, requiring only a small pulling force.

It is an object of the present invention to provide an apparatus for gapping a continuous slide fastener stringer, which enables the fastener stringer to be placed in position with maximum ease.

Another object of the invention is to provide an apparatus for gapping a continuous slide fastener stringer without injuring or breaking a stringer tape.

Many other advantages, features and additional objects of the present invention will become manifest to those versed in the art upon making reference to the detailed description and the accompanying sheets of drawings in which a preferred structural embodiment incorporating the principles of the present invention is shown by way of example.

DETAILED DESCRIPTION OF THE PREFERRED EMBODIMENT

Figure 1:
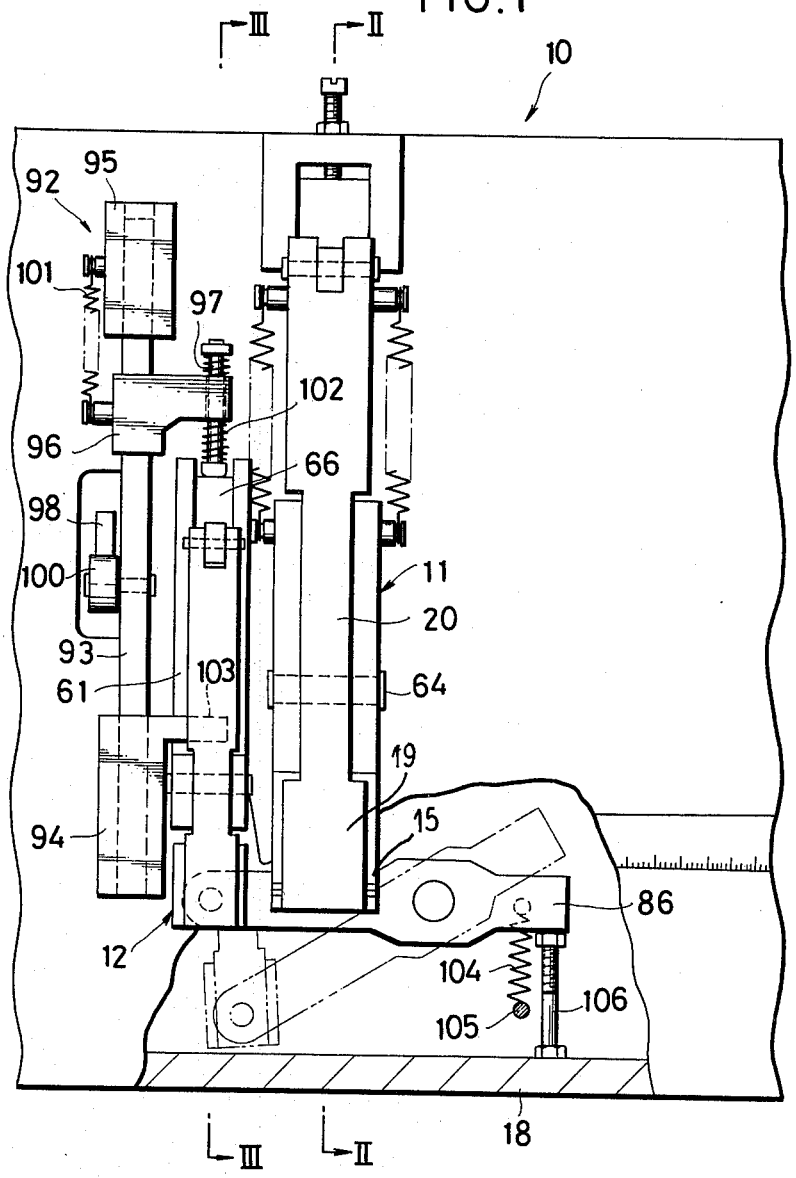
FIG. 1 is a plan view, with parts broken away, of an apparatus for gapping a continuous slide fastener stringer in accordance with the present invention.

The principles of the present invention are particularly useful when embodied in an apparatus such as shown in FIG. 1, generally indicated by the numeral 10.

Figure 2:
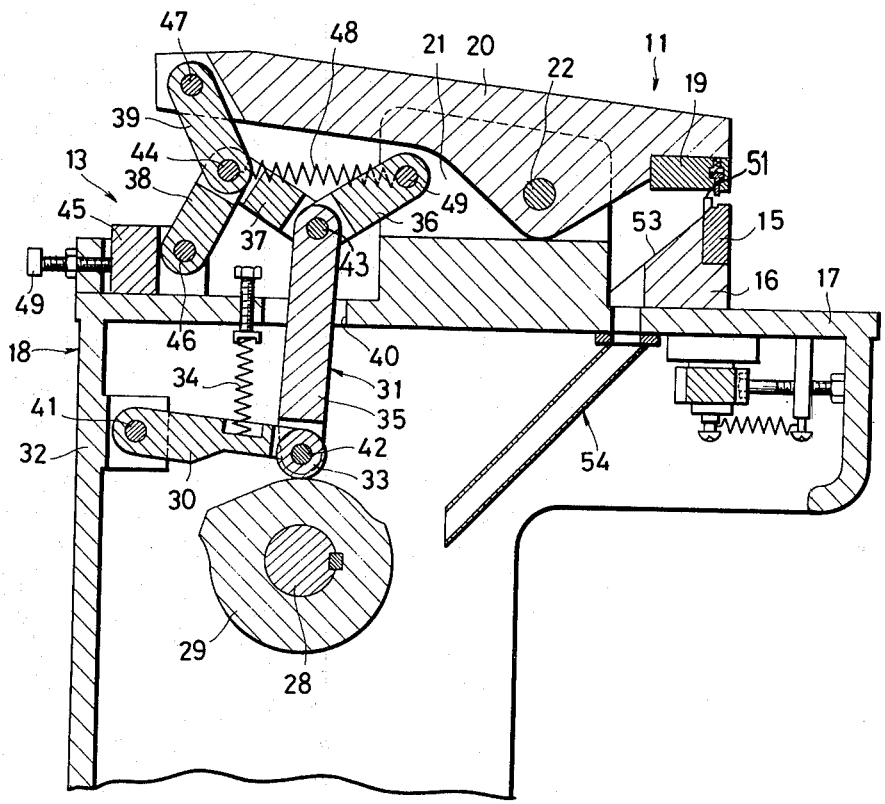
FIG. 2 is a cross-sectional view taken along line II—II of FIG. 1.
Figure 3:
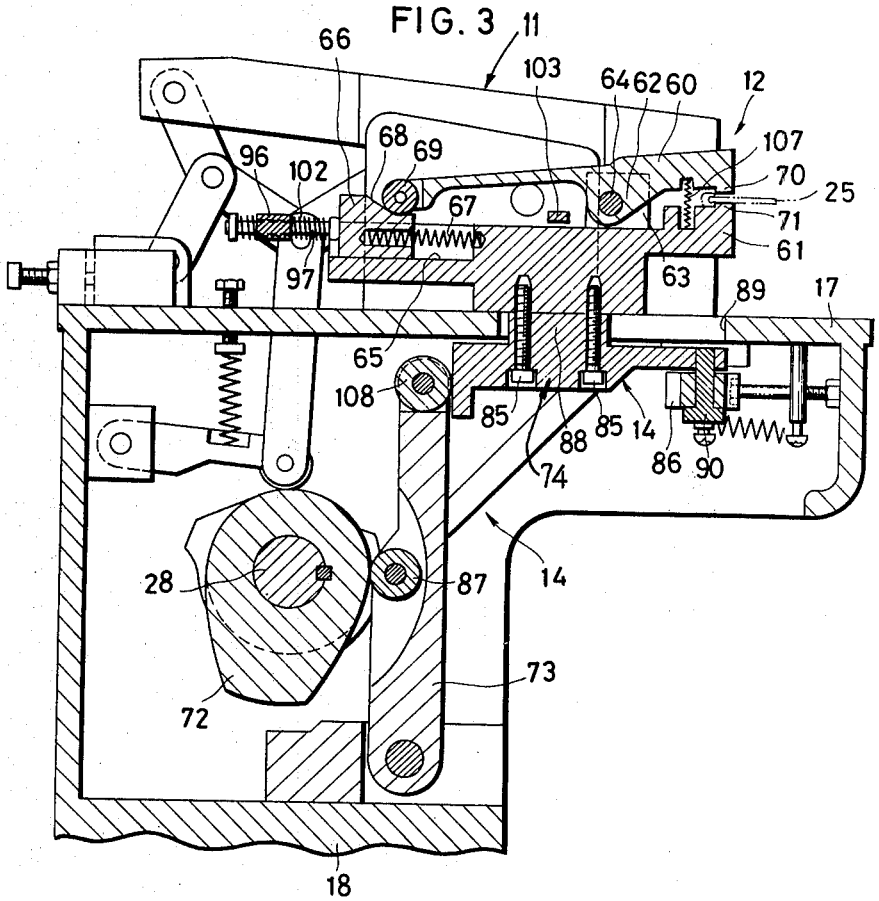
FIG. 3 is a cross-sectional view taken along line III—III of FIG. 1.

The apparatus 10 generally comprises a fastener-element pressing and holding unit (hereinafter referred to as "presser unit") 11, a tape gripping and moving unit (hereinafter referred to as "gripper unit") 12, a presser unit (or first) drive mechanism 13 (FIG. 2), and a gripper unit (or second) drive mechanism 14 (FIG. 3).

Figure 7:
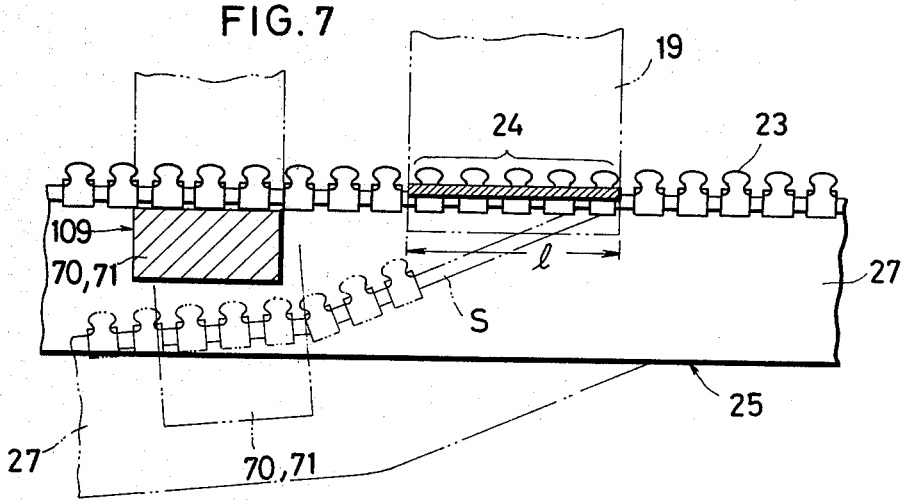
FIG. 7, appearing with FIG. 5, is a schematic view showing the positional relationship between the fastener stringer to be gapped and the pressing unit and the gripping unit, and the manner in which the fastener elements are removed.
Figure 6A:
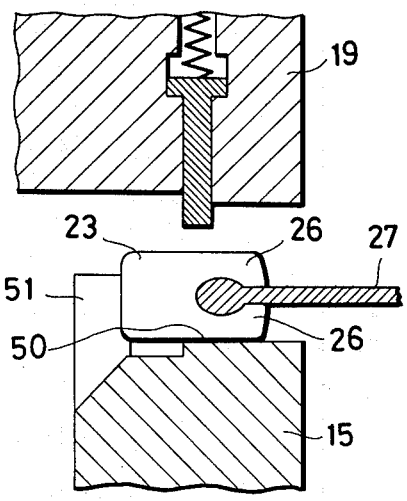
FIGS. 6A–6D are fragmentary, enlarged cross-sectional views of the fastener-element pressing unit, showing the manner in which the fastener elements are pressed and then removed from the tape.
Figure 6B:
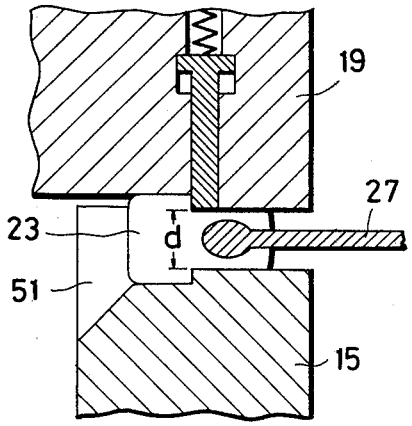

As shown in FIG. 2, the presser unit 11 includes a die 15 supported on a stand 16 which is mounted on a horizontal plate 17 of a frame 18 of the apparatus 10, and a coacting punch 19 fixed to one end of an elongate punch holder 20 which is pivotally supported on a bracket 21 projecting upwardly from the horizontal frame plate 17 by a pin 22. The punch holder 20 is operatively connected at the other end to the first drive mechanism 13 for pivotal movement. The punch 19 and the die 15 are aligned vertically with each other, and the punch 19 is movable toward and away from the die 15, in response to the pivotal movement of the punch holder 20, to press or deform a group of fastener elements 23 (FIG. 7) in a first portion 24 of a slide fastener stringer 25 placed on the die 15, so as to reduce the thickness of their leg portions 26 (FIGS. 6A and 6B). The stringer 25 has a continuous row of fastener elements 23 secured to a stringer tape 27 along one longitudinal edge thereof, each of the fastener elements 23 being mounted astride of the tape 27. The punch 19 has a predetermined width which corresponds to the length l (FIG. 7) of the first stringer portion 24.

The first drive mechanism 13, as best shown in FIG. 2, includes a camshaft 28 which is connectable with a drive shaft (not shown) by means of a clutch (not shown) for rotation, a first cam plate 29 mounted on the camshaft 28, a cam follower 30, and a toggle joint 31. The cam follower 30 is pivotally supported at one end on a vertical plate 32 of the frame 18 by a pin 41 and has at the other end a roller 33 rotatable on a pin 42. The cam follower 30 is normally urged toward the cam plate 29 by a compression spring 34 so that the roller 33 engages with the cam plate 29 on its peripheral cam surface.

The toggle joint 31 is composed of one relatively long link 35 and four relatively short links 36,37,38,39. The long link 35 is pivotally connected at one end to said other end of the cam follower 30 by the pin 42 and extends upwardly through an aperture 40 in the horizontal frame plate 17, the other end of the long link 35 being pivotally connected to one end of each of the two short links 36,37 by a pin 43. The other end of the short link 36 is pivotally connected to the bracket 21 of the horizontal frame plate 17 by a pin 49. The other end of the short link 37 is pivotally connected to one end of each of the remaining two short links 38,39 by a pin 44. The other end of the short link 38 is pivotally connected to a block 45 by a pin 46. The other end of the short link 39 is pivotally connected to said other end of the punch holder 20 by a pin 47. An extension spring 48 is mounted between the two pins 49,44 to normally urge the one end of each of the two short links 38,39 toward the pin 49, i.e. rightwardly in FIG. 2. The block 45 is adjustably mounted on the frame 18 by means of a screw 49 so that the extent of stroke of the punch 19 can be adjusted; that is, the thickness d (FIG. 6B) of the pressed fastener element leg portions 26 can be adjusted.

The die 15 has a width greater than that of the punch 19 (FIG. 1) and has a suitably stepped top surface 50 (FIGS. 6A–6D). Further, the die 15 has a pair of upwardly projecting stops 51,51 (FIGS. 2, 4 and 6A–6D) disposed one on each side of the punch 15, as viewed in plan, so that the group of fastener elements 23 to be pressed can be positioned in vertical alignment with the punch 15 just by placing said group of fastener elements 23 between the stops 51,51. The die 15 is provided with a slope 52 (FIG. 6D) slanting down to the left from its rear end and adjoining a slope 53 (FIG. 2) of the die stand 16, the latter slope 53 in turn leading to a chute 54 through which the released fastener elements 23 passing over the combined slope 52,53 are discharged.

Figure 5:
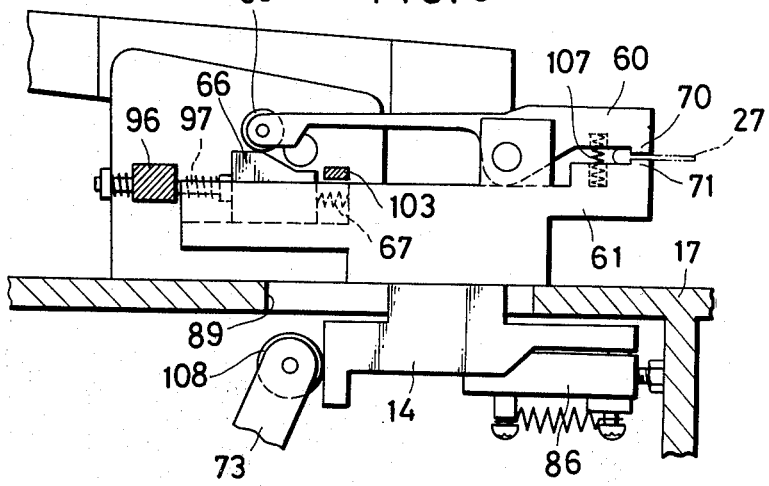
FIG. 5 is a side elevational view of a broken away portion of the apparatus of FIG. 1, showing the tape gripping unit in its advanced position.

As shown in FIG. 3, the gripper unit 12 is disposed alongside of the presser unit 11 (FIG. 1) and includes a pair of upper and lower grip members 60,61. The lower grip member 61 is slidably mounted on the horizontal frame plate 17 and is movable between its normal or retracted position (FIG. 3) and its advanced position (FIG. 5). The upper grip member 60 is pivotally supported at 62 on a bracket 63 by a pin 64, the bracket 63 projecting upwardly from the lower grip member 61. The lower grip member 61 has in its rear end a longitudinally extending guide groove 65 in which a cam block 66 is slidably received, there being a compression spring 67 mounted between the cam block 66 and the lower grip member 61 so as to normally urge the cam block 66 rearwardly. The cam block 66 has a cam surface 68 against which a roller 69 rotatably mounted on the rear end of the upper grip member 60 is normally urged, by means of a compression spring 107 mounted between the upper and lower grip members 60,61. The cam surface 68 slopes down to the right as viewed in FIG. 3 so that, when the cam block 66 is pushed forward against the bias of the compression spring 67 by a cam block pushing mechanism 92 (FIG. 1) described below, the upper grip member 60 pivots clockwise about the pin 64 to close a pair of grip portions 70,71 formed on respective front ends of the upper and lower grip members 60,61 (FIG. 3). When the cam block 66 is moved backward, the upper grip member 60 pivots counterclockwise to open the pair of grip portions 70,71 (FIG. 3).

The gripper unit (or second) drive mechanism 14, as best shown in FIG. 3, includes a second cam plate 72 mounted on the camshaft 28, a cam follower 73 pivotally supported on the frame 18, an attachment member 74 attached to the lower grip member 61 on its underside by a number of bolts 85, and a guide lever 86 (FIG. 4) for guiding the attachment member 74 to follow an arcuate path. The cam follower 73 has a first roller 87 resting on a peripheral cam surface of the second cam plate 72 and a second roller 108 engaging with the rear end of the attachment member 74 so that, when the second cam plate 72 rotates, the attachment member 74, together with the upper and lower grip members 60,61, is moved forwardly and backwardly according to the geometry of the second cam plate 72.

Figure 4:
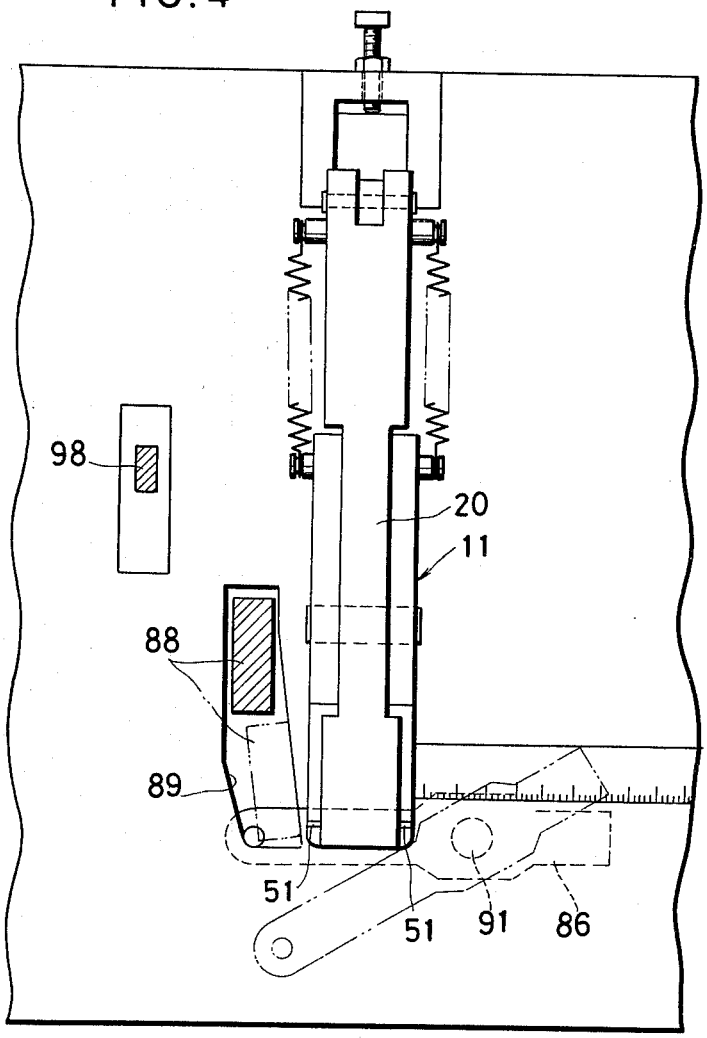
FIG. 4 is a plan view, with parts broken away, of the apparatus of FIG. 1, showing the movement of a tape gripping unit relative to a fastener-element pressing unit.

The attachment member 74 has a connecting portion 88 extending through a slightly doglegged guide aperture 89 (FIG. 4). The attachment member 74 is pivotally connected at its front end to one end of the guide lever 86 by a pin 90, the guide lever 86 being pivotally supported on the underside of the horizontal frame plate 11 by a pin 91 (FIG. 4). Accordingly, the attachment member 74 (only the connecting portion 88 of which is shown in FIG. 4) is movable between the solid line position and phantom line position in response to pivotal movement of the guide lever 86, following an arcuate path; that is, the gripper unit 12 follows substantially the same arcuate path as it is moved between the solid line position and the phantom line position (FIG. 1).

The guide lever 86, as shown in FIG. 1, is normally urged to pivot clockwise, as viewed in this Figure, by means of an extension spring 104 mounted between the other end of the guide lever 86 and a pin 105 fixed to the frame 18. A bolt 106 serves as a stop for limiting the clockwise movement of the guide lever 86.

The pushing mechanism 92 for the cam block 66, as shown in FIG. 1, includes a rod 93 extending parallel to the lower grip member 61 and slidably supported by a pair of stationary front and rear guide blocks 94,95, an arm 96 mounted on the rod 93, a push rod 97 slidably supported on a free end of the arm 96 for pushing the cam block 66, a lever 98 pivotally supported on the frame 18 for moving the rod 93 in the axial direction, and a cam plate (not shown) mounted on the camshaft 28. Assuming that the lever 98 pivots so as to push the rod 93 forwardly, i.e. downwardly as viewed in FIG. 1, through the medium of a roller 100 mounted on the rod 93, the arm 96 is moved forwardly against the bias of an extension spring 101 mounted between the rear guide block 94 and the arm 96. This movement causes the push rod 97, through the medium of a compression spring 102, to move forwardly to push the cam block 66 against the bias of the compression spring 67, as shown in FIG. 5. As a result, the pair of grip portions 70,71 are closed to grip the stringer tape 27 as aforementioned. The front guide block 94 has a horizontally projecting stop 103 (FIGS. 1, 3 and 5) for limiting the forward movement of the cam block 66.

Figure 6C:
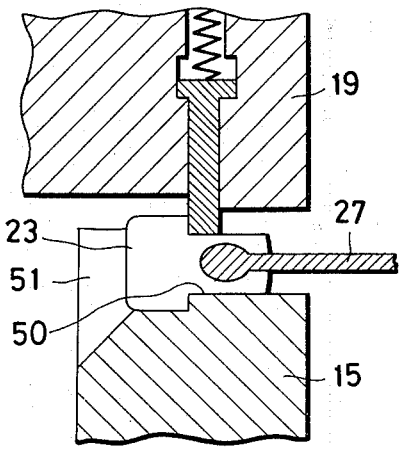
Figure 6D:
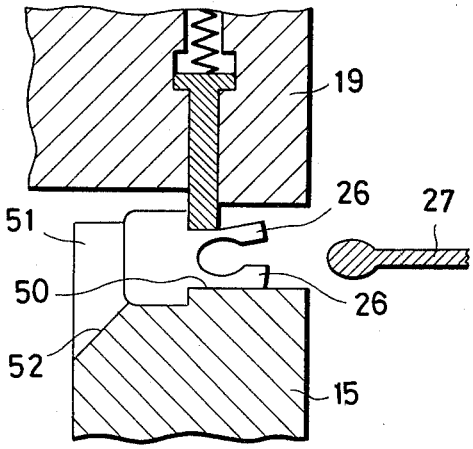

The apparatus 10 thus operates in the following manner. The slide fastener stringer 25 is placed by hand between the punch 19 and the die 15 and between the pair of grip portions 70,71 such that the group of fastener elements 23 to be removed is positioned away from the operator and in vertical alignment with the punch 19, and with other fastener elements 23 disposed to the rear of the grip portions 70,71. Thereafter, the camshaft 28 is connected to the drive shaft (not shown) for rotation by actuating the clutch (not shown) by a suitable means (not shown), whereupon the punch 19 is lowered to press or deform the group of fastener elements 23 to reduce the thickness of their leg portions 26 (FIG. 6B), thereby forming forwardly facing shoulders for engaging rearwardly facing shoulders on the punch 19 and the die 15. The punch is slightly raised to provide a clearance as shown in FIG. 6C, whereby the punch shoulder, under the influence of the illustrated spring, remains in contact with the upper shoulders of the fastener elements. Such clearance enables the leg portions to be deflected apart as shown in FIG. 6D. Simultaneously with the lowering of the punch 19, the grip portion 70 of the upper grip member 60 is lowered to grip the opposite sides of the stringer tape 27 at a second portion 109 (FIG. 7) of the stringer 25, from the fastener element side thereof. Subsequently, the gripper unit 12 is advanced from the solid line position to the phantom line position (FIG. 1), thereby moving the tape 27 from the solid line position to the phantom line position (FIG. 7) while the pressed fastener elements 23 are held in position by the punch 19 and the die 15 (FIG. 6C). At that time, the gripper unit 12 follows an arcuate path. This path causes the group of fastener elements 23 in the first portion 24 of the stringer 25 to be removed seriatim (FIG. 6D) from the tape 27. Thus, a gap s (FIG. 7) devoid of the fastener elements 23 has been formed in the stringer 25. Then, the grip portions 70,71 are opened so that the stringer 25 can be taken out. The presser unit 11 and the gripper unit 12 and their associated parts are then returned to respective original or retracted positions shown in FIGS. 2 and 3.

Figure 8:
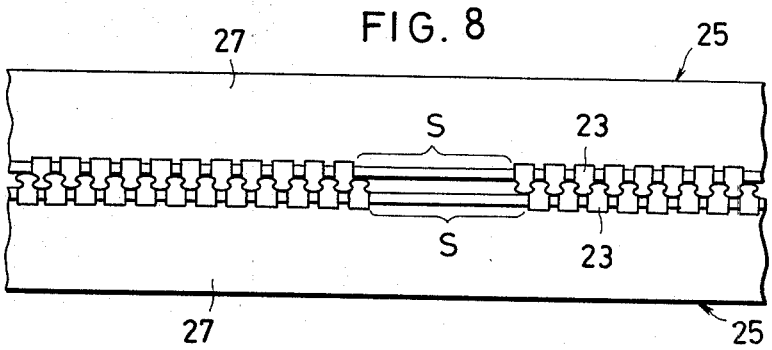
FIG. 8, appearing with FIG. 5, is a fragmentary plan view of a pair of slide fastener stringers each having an element-free gap formed by the apparatus according to the present invention.

FIG. 8 shows a pair of slide fastener stringers 25,25 each having an element-free gap s formed by the apparatus 10 according to the present invention.

According to the apparatus 10 thus constructed, the gripper unit 12 is disposed alongside of the presser unit 11 to grip the stringer tape 27 from the fastener-element side of the stringer 25. In other words, there is no part located at the tape side (right side as viewed in FIGS. 2 and 3) of the stringer 25. Therefore, the stringer 25 to be gapped can be placed between the punch 19 and the die 15 and between the upper and lower grip portions 70,71 with maximum ease, at which time the group of fastener elements 23 to be pressed can be positioned between the punch 19 and the die 15 correctly.

Moreover, because the gripper unit 12 follows an arcuate path as it is moved from its normal position to its advanced position (FIG. 7), the fastener elements 23 in the first portion 24 of the stringer 25 can be removed seriatim, requiring only a small pulling force. This processing does not injure or break the tape 27 during gapping operation. Further, since the upper and lower grip portions 70,71 are opened to release the tape 27 as they are in the advanced position indicated in phantom in FIG. 7, the gapped stringer 25 can be taken out with ease.

Although various minor modifications may be suggested by those versed in the art, it should be understood that I wish to embody within the scope of the patent warranted hereon all such embodiments as reasonably and properly come within the scope of my contribution to the art.

What is claimed is:

1. An apparatus for gapping a slide fastener stringer having a continuous row of fastener elements having leg portions secured to a stringer tape along one longitudinal edge thereof, said apparatus comprising:

(a) a frame;

(b) a presser unit mounted on said frame remotely from the tape side of the stringer and having a punch and die, said punch and die normally being separated from each other by a first laterally unobstructed space for receiving a first portion of a manually fed stringer edgewise, the fastener elements being at the leading edge during such receiving, at least one of said punch and die being movable toward and away from the other for pressing a group of the fastener elements, in the first portion of the stringer placed therebetween, to reduce the thickness of their leg portions, and for holding the pressed fastener elements;

(c) a gripper unit disposed on said frame remotely from the tape side of the stringer and along-side said pressure unit and having a pair of relatively pivotable grip members, said grip members normally being separated from each other by a second laterally unobstructed space for simultaneously receiving a second portion of the manually fed stringer edgewise, the fastener elements being at the leading edge during such receiving, the grip members being adapted to grip the tape on the opposite sides of the second portion of the stringer from the fastener element side thereof while encircling the adjacent fastener elements, the gripper unit being spaced away from the presser unit in a longitudinal direction of the stringer, said gripper unit being movable on said frame between its normal position and an advanced position in an arcuate path for moving the gripped second portion of the tape to remove said group of fastener elements from said first portion seriatim;

(d) a first drive means operatively connected to said one of said punch and die for moving the same toward and away from each other;

(e) a second drive means operatively connected to said gripper unit for moving the same between said normal and advanced positions; and (f) a third drive means operatively connected to one of said grip members for moving the same toward and away from the other.

2. An apparatus according to claim 1, said second drive means including a camshaft adapted to be operatively connected to a drive shaft for rotation, a cam plate mounted on said camshaft for corotation therewith, a cam follower pivotable in response to rotation of said cam plate to move said gripper unit toward said advanced position, and a guide lever pivotable on said frame and having one end pivotally connected to said gripper unit for guiding the same to follow said arcuate path.

3. An apparatus according to claim 2, said second drive means further including an attachment member attached to the other grip member, said one end of said guide lever being pivotally connected to said attachment member.

4. An apparatus according to claim 2, said third drive means including a roller rotatably mounted on said one of said grip members, a cam block slidably mounted on said other grip member and engageable with said roller for raising and lowering the same, and a push rod disposed against a side of said cam block and operatively connected to said camshaft for pushing said cam block in response to rotation of said camshaft.

5. An apparatus according to claim 4, said third drive means further including a stop disposed on the opposite side of said cam block for limiting the extent to which said cam block is moved forward.

* * * * *